US007694835B1

(12) United States Patent
Montgomery

(10) Patent No.: US 7,694,835 B1
(45) Date of Patent: Apr. 13, 2010

(54) DRAFTED NECK FINISH HAVING ANGLED THREAD FACE AND CLOSURE PACKAGE

(75) Inventor: Gary V. Montgomery, Evansville, IN (US)

(73) Assignee: Rexam Closures and Containers Inc., Evansville, IN (US)

( * ) Notice: Subject to any disclaimer, the term of this patent is extended or adjusted under 35 U.S.C. 154(b) by 1264 days.

(21) Appl. No.: 11/028,935

(22) Filed: Jan. 4, 2005

(51) Int. Cl.
*B65D 41/04* (2006.01)
*B65D 41/08* (2006.01)
*B65D 41/06* (2006.01)
*B65D 41/34* (2006.01)

(52) U.S. Cl. ..... 215/329; 215/44; 220/288; 411/415; 411/416; 411/426

(58) Field of Classification Search ..... 215/214–117, 215/321, 329, 44, 276, 337, 338, 43–45, 215/330; 220/252, 288; 411/366.1, 416, 411/426, 415, 423; 285/333
See application file for complete search history.

(56) References Cited

U.S. PATENT DOCUMENTS 650,429 A * 5/1900 Smith ..... 220/288
759,168 A 5/1904 Fenn
1,407,335 A * 2/1922 Reynolds et al. ..... 285/85
1,702,878 A 2/1929 Mersfelder et al.
RE017,528 E 12/1929 Mersfelder et al.
RE017,667 E 5/1930 Mersfelder et al.
RE018,100 E 6/1931 Mersfelder et al.
2,207,005 A * 7/1940 Haas ..... 403/334
2,669,468 A 2/1954 Clerke
2,822,418 A * 2/1958 Dinnick ..... 174/88 C
3,237,817 A * 3/1966 Wheeler ..... 222/519
3,281,295 A 10/1966 Capucio
3,297,187 A 1/1967 Thiesen
3,492,906 A * 2/1970 Hauser ..... 411/389
3,664,540 A * 5/1972 Witkin ..... 220/288
3,734,332 A 5/1973 Grulich
3,870,182 A * 3/1975 Georgi ..... 215/220
3,888,373 A * 6/1975 Gach et al. ..... 215/214
3,917,097 A * 11/1975 Uhlig ..... 215/216
3,923,181 A * 12/1975 Libit ..... 215/224
3,954,200 A * 5/1976 Willis ..... 215/44

(Continued)

FOREIGN PATENT DOCUMENTS

DE 2323561 11/1974

(Continued)

*Primary Examiner*—Anthony Stashick
*Assistant Examiner*—Ned A Walker
(74) *Attorney, Agent, or Firm*—James E. Cole; Chad D. Bruggeman; Middleton Reutlinger

(57) ABSTRACT

The present invention comprises a neck extending upwardly from a container and having an upper rim defining a neck opening. The neck has a substantially vertical sidewall of a constant thickness and at least one container neck thread extending from the sidewall. The at least one neck thread has an outer thread face drafted from a radially inward upper position to a radially outward lower position. The device further comprises a closure having a top wall and a skirt depending from the top wall, wherein the skirt is tapered. The closure comprises a closure thread extending helically along an inner surface of the skirt. The container thread has increasing radial length moving downwardly along the container neck.

14 Claims, 9 Drawing Sheets

U.S. PATENT DOCUMENTS

| | | | | | |
|---|---|---|---|---|---|
| 4,020,965 | A | * | 5/1977 | Northup | 215/213 |
| 4,113,290 | A | * | 9/1978 | Miida | 285/334 |
| 4,129,228 | A | | 12/1978 | Stoneback | |
| 4,280,631 | A | * | 7/1981 | Lohrman | 215/204 |
| 4,410,204 | A | * | 10/1983 | Reimert | 285/24 |
| 4,429,904 | A | * | 2/1984 | Reimert | 285/24 |
| 4,562,930 | A | | 1/1986 | Lecinski et al. | |
| 4,667,836 | A | * | 5/1987 | McLaren | 215/216 |
| 4,682,700 | A | * | 7/1987 | Montgomery et al. | 215/216 |
| 4,697,715 | A | * | 10/1987 | Beruvides | 215/330 |
| 4,717,183 | A | * | 1/1988 | Nobileau | 285/334 |
| 4,743,146 | A | * | 5/1988 | Khmelnitsky et al. | 408/221 |
| 4,798,303 | A | | 1/1989 | Arnold | |
| 4,958,973 | A | * | 9/1990 | Sugimura | 411/423 |
| 5,096,083 | A | * | 3/1992 | Shaw et al. | 220/304 |
| 5,186,344 | A | | 2/1993 | Cook | |
| 5,213,224 | A | | 5/1993 | Luch | |
| 5,282,708 | A | * | 2/1994 | Giannuzzi | 411/386 |
| 5,462,315 | A | * | 10/1995 | Klementich | 285/24 |
| 5,464,110 | A | | 11/1995 | Heyworth | |
| 5,553,727 | A | | 9/1996 | Molinaro | |
| 5,593,055 | A | | 1/1997 | Repp et al. | |
| 5,785,195 | A | | 7/1998 | Zwemer et al. | |
| 5,836,466 | A | | 11/1998 | Briere et al. | |
| 5,884,787 | A | * | 3/1999 | Quintard et al. | 215/216 |
| 5,901,867 | A | * | 5/1999 | Mattson | 215/261 |
| 5,921,417 | A | | 7/1999 | Mull | |
| 6,003,700 | A | * | 12/1999 | Julian et al. | 215/216 |
| 6,059,134 | A | * | 5/2000 | Long, Jr. | 215/252 |
| 6,102,223 | A | | 8/2000 | Montgomery | |
| 6,102,224 | A | | 8/2000 | Sun et al. | |
| 6,367,640 | B1 | * | 4/2002 | Julian | 215/329 |
| 6,854,614 | B2 | * | 2/2005 | Sprick | 215/329 |
| 6,905,080 | B2 | * | 6/2005 | Pohorecki | 239/280 |
| 6,959,830 | B1 | * | 11/2005 | Kanou et al. | 220/288 |
| 7,527,304 | B2 | * | 5/2009 | Mallis et al. | 285/390 |
| 2002/0011458 | A1 | * | 1/2002 | Sprick | 215/330 |
| 2002/0053552 | A1 | * | 5/2002 | Moretti | 215/44 |
| 2003/0116524 | A1 | * | 6/2003 | Robinson et al. | 215/349 |
| 2005/0067365 | A1 | * | 3/2005 | Hanafusa et al. | 215/43 |
| 2005/0263476 | A1 | * | 12/2005 | Harrison et al. | 215/44 |
| 2006/0042707 | A1 | * | 3/2006 | Sugimura et al. | 138/30 |
| 2007/0029325 | A1 | * | 2/2007 | Herold | 220/288 |
| 2007/0080128 | A1 | * | 4/2007 | Laveault et al. | 215/44 |

FOREIGN PATENT DOCUMENTS

| | | |
|---|---|---|
| DE | 3530348 | 1/1986 |
| EP | 0350415 | 1/1990 |
| FR | 1294847 | 4/1962 |
| FR | 1506014 | 11/1967 |
| GB | 1004277 | 9/1965 |
| JP | 1-226559 | 9/1989 |
| JP | 6-122465 | 5/1994 |
| NO | 107898 | 1/1966 |

* cited by examiner

PRIOR ART

DRAFTED NECK FINISH HAVING ANGLED THREAD FACE AND CLOSURE PACKAGE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTINGS, ETC.

None

BACKGROUND

1. Field of the Invention

The present invention comprises a closure and container combination or package. More specifically, the present invention provides a package having a closure including drafted threads and a complimentary container neck having at least one complimentary drafted thread.

2. Description of the Related Art

Various closure and container combinations or packages have been developed for instance to provide a means for sealably engaging a container neck and inhibiting leakage therefrom. As shown in FIG. 1, many closures or caps utilize a tapered skirt, from smaller upper diameter to larger lower diameter, in order to more easily remove the closure from the mold core during de-molding. For example, closures may be tapered about one to two degrees. However, it may be desirable to increase the taper in order to further reduce the difficulty with removing a closure from a mold.

In addition to the tapered skirt, drafted or tapered closure threads have been utilized in order to provide additional aid to removal of the closure from the mold core during manufacture. The tapered closure threads typically have been about ¼° (degree) or more of draft in order to reduce torque during removal of the closure from a mold core in the manufacturing process. Without such taper, a constant and continuous torque is required to remove the closure from the mold core. Thus, the drafted closure threads and tapered closure skirt, in combination, provide for improved removal of the closure from the tooling.

However, this tapered closure skirt and thread design has resulted in several problems. First, since the closure skirt is tapered and extends away from the container neck, the threads of the closure and container lose engagement farther down the neck as depicted. More specifically, FIG. 1 depicts thread engagement lengths $T_1$-$T_4$, measured in a radial direction. $T_1$ is shown at the top of the package having the largest engagement length, measured in a radial direction, while $T_4$ is shown at the bottom of the package having the shortest engagement length due to the taper of the closure skirt away from the container neck finish. Decreasing engagement of the closure threads and container threads is highly undesirable and results in stripping and loosening of the closure and container threads.

One means for overcoming this problem is to taper the bottle neck to match the taper of the closure skirt and threads. But, since most bottle necks are molded utilizing a mold core and cavity tooling, tapering the bottle neck makes it impossible to remove a bottle neck from the mold. In order to overcome this molding issue, it might be possible to utilize a parallel sided core producing a non-uniform neck wall however, this is a cost prohibitive manufacturing technique due to added material and longer processing cycle.

Given these deficiencies a structure is needed which overcomes these problems providing increased engagement of closure and container threads along the axial length of the container neck.

SUMMARY OF THE INVENTION

With regard to the foregoing, the present invention eliminates the oversights, difficulties, and disadvantages of the prior art by providing a drafted neck finish and closure package.

More specifically, the present invention comprises a neck extending upwardly from a container and having an upper rim defining a neck opening. The neck has a substantially vertical sidewall of a constant thickness and at least one container neck thread helically extending from the sidewall. The at least one container neck thread has an outer thread face drafted from a radially inward upper position to a radially outward lower position. The container thread has increasing radial length moving downwardly along the container neck. The device further comprises a closure having a top wall and a skirt depending from the top wall, wherein the skirt is tapered. The closure comprises a closure thread extending helically along an inner surface of the skirt. The outer thread face is substantially parallel to said closure skirt. The outer thread face and closure skirt define a gap of constant radial thickness. The outer thread face of the at least one container neck thread is linearly aligned with adjacent rotations of said container neck thread. The closure may be a single shell closure or a double shell closure. The outer thread face of the at least one container thread may be tapered between about one-quarter degree and about eight degrees from a vertical reference. The skirt taper may be between about one-quarter degree and about eight degrees from a vertical reference in order to be substantially parallel. The container neck and closure combination further comprises at least one closure thread extending from the closure, an innermost thread face of the at least one closure thread being tapered at least about one-quarter degree. The closure may further comprise a sealing device. The package may further comprise an on-stop feature, a child-resistant feature, and a tamper-indicating feature.

DETAILED DESCRIPTION

Given the foregoing deficiencies, it will be appreciated that a drafted neck finish and closure thread is needed which maximizes thread engagement, strength, and centering of the closure on the neck finish.

Referring now in detail to the drawings, wherein like numerals indicate like elements throughout the several views, there are shown in FIGS. 2-9 various aspects of a drafted neck finish and closure thread package 10. For purpose of this description, the terms draft or drafted are meant to be interchangeable with the terms taper or tapered. The drafted neck finish and closure thread package of the present invention maximizes the thread engagement along the axial length of the closure, strength and centering of the closure during application on the container neck. Alternatively stated, the radial engagement of the closure and container threads is greater than prior art devices between consecutive thread rotations moving downwardly along the container neck.

Figure 1:
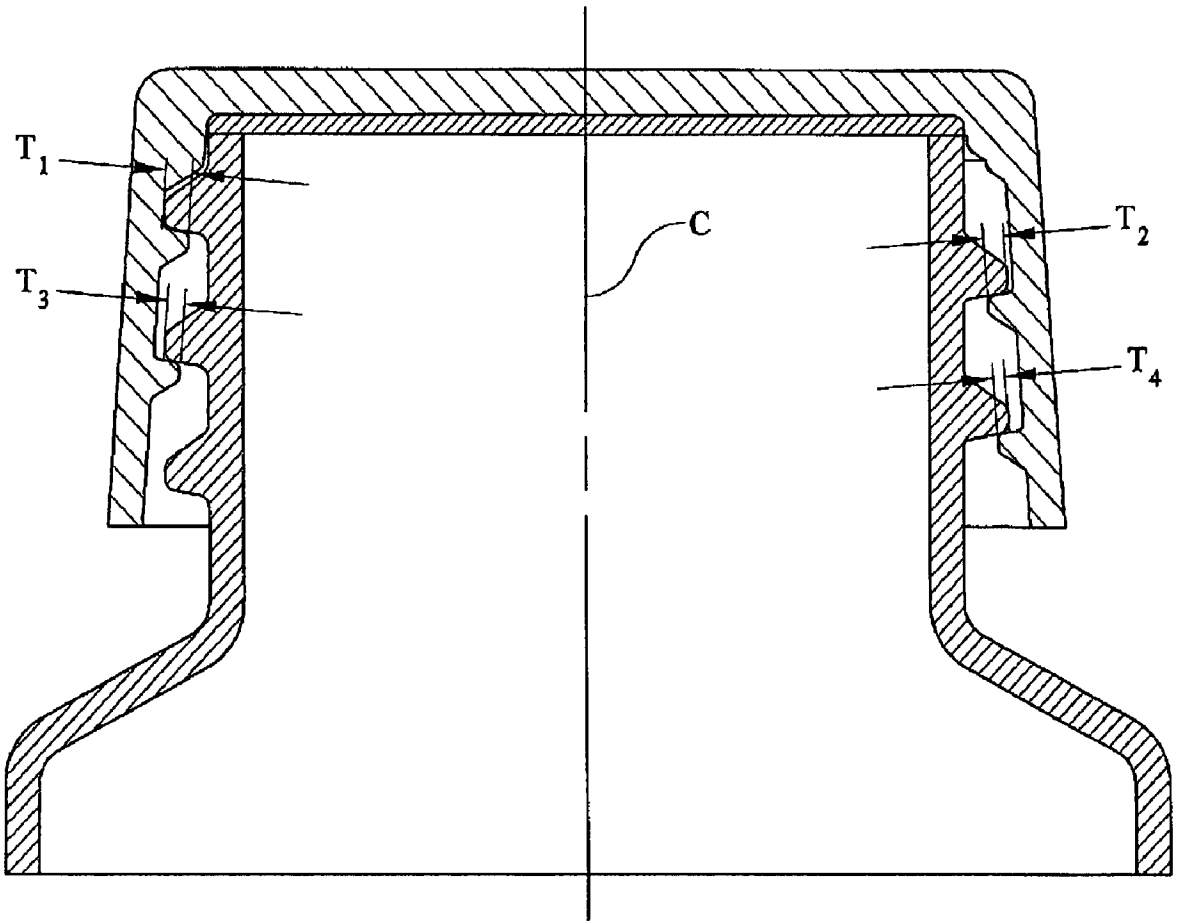
FIG. 1 is a side sectional view of a prior art device depicting thread disengagement along an axial length of the container neck and closure.
Figure 2:
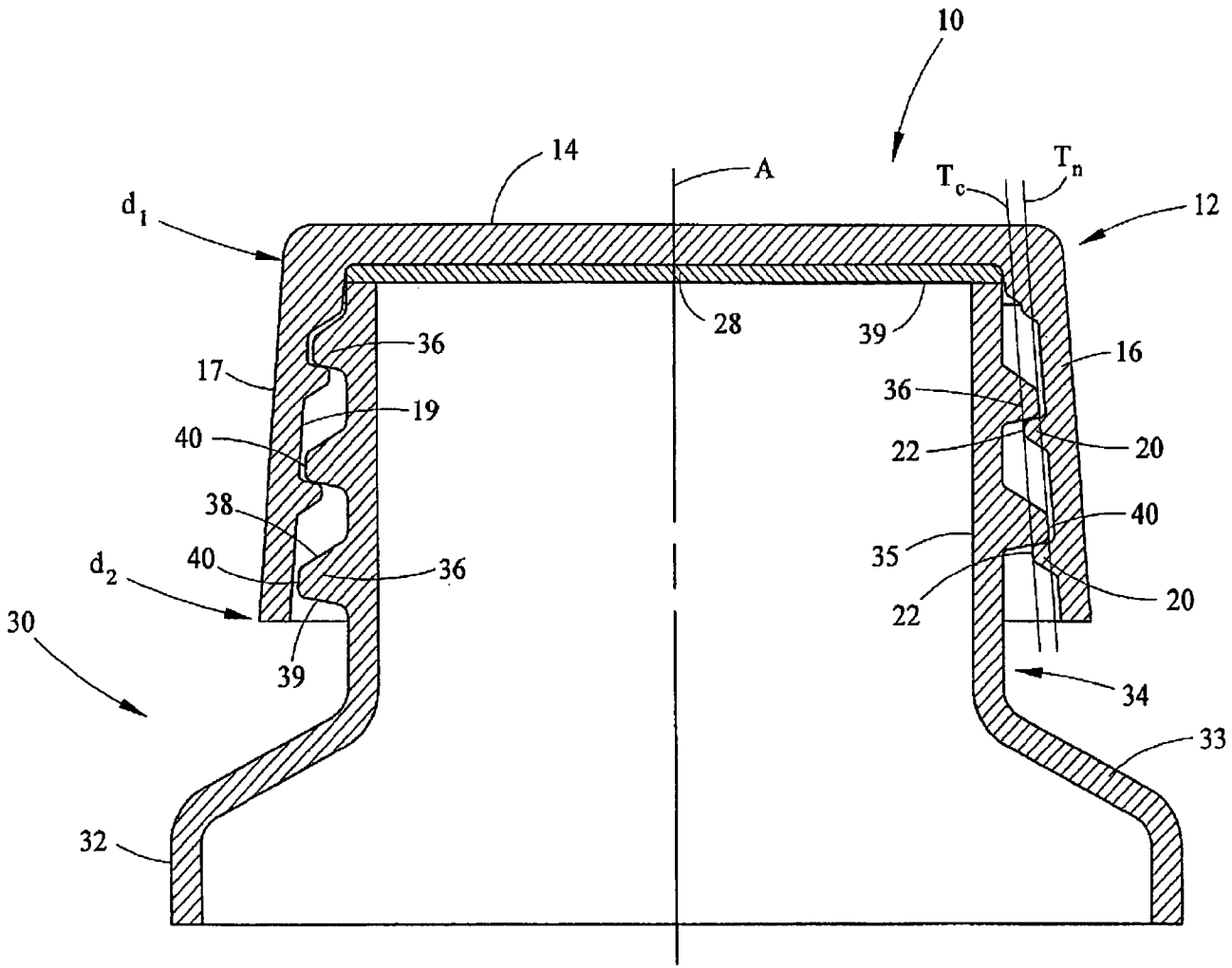
FIG. 2 is a side-sectional view of the closure-container package of the present invention.

With reference initially to FIG. 2, a package 10 is shown comprising a closure 12 and a container 30. The closure 12 may be molded of, for example, polyethylene, polypropylene or some other polymeric material or combination of polymeric materials. The closure 12 comprises a circular top wall 14 and a skirt 16 depending from a peripheral edge of the skirt 16. The closure 12 functions to provide a repeatably sealing and closing structure for the container 30 as will be described further herein. The closure 12 is substantially frusto-conical in shape meaning the closure 12 has an upper diameter $d_1$ and a lower diameter $d_2$ wherein $d_1$ is less than $d_2$. Alternatively stated, at least the inner surface of the skirt 16 is tapered. Due to the tapered design of the closure skirt 16, the closure 12 may be removed more easily than a vertical skirt design. As a result, the tapered skirt 16 is shown disposed at an angle from a vertical axis A, which is perpendicular to the top wall 14, such that the skirt 16 is disposed at an angle of greater than about ¼° (degree) from the vertical. As previously indicated, the greater the taper, the easier closure removal from the mold becomes. Preferably the angle of the skirt 16 is between about ¼° and 8° (degrees).

Figure 6:
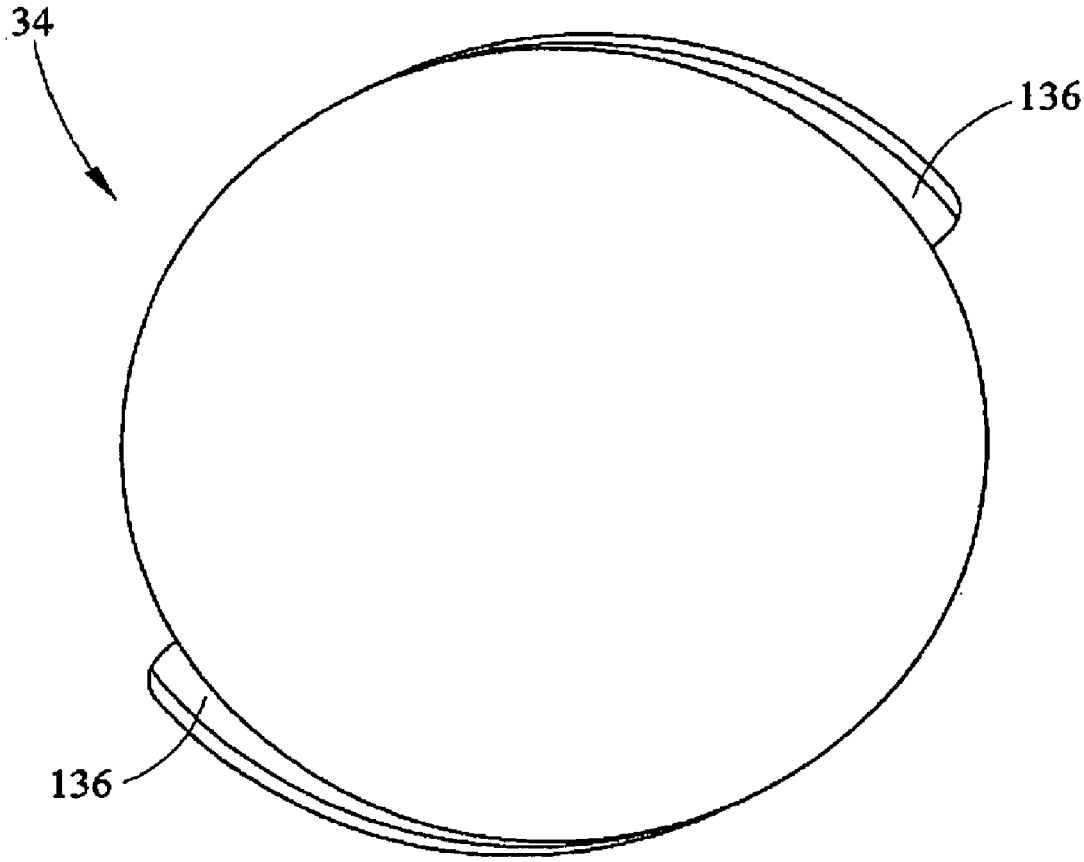
FIG. 6 is a top view of a drafted neck finish have multiple helices.

With reference still to FIG. 2, the skirt 16 comprises an outer surface 17 and an inner surface 19. The outer surface 17 may include a plurality of knurlings or other gripping aid to help the user grip and rotate the closure in either a clockwise or counter-clockwise motion in order to close or open the package 10. Extending from the inner surface 19 of the skirt 16 is at least one drafted thread 20 helically extending about the inner surface of the skirt 16 through some preselected arcuate distance. The term drafted should be understood by one of ordinary skill in the art as meaning angled from a reference point, line or axis. According to one embodiment, the at least one thread 20 helically extends through an arcuate distance of at least one rotation along the inner surface of the closure skirt 16. Alternatively however, as shown in FIG. 6, multiple thread leads may be utilized to extend through various preselected arcuate distances. Consecutive thread rotations of the closure thread 20 define a groove therebetween wherein a complementary container thread 36 may be positioned by rotation in order to dispose the closure 12 on the container neck 34. The at least one thread 20 provides a frictional connection between the closure 12 and container neck 34. The thread 20 is substantially frusto-conical in shape and asymmetrical about a radially extending axis. According to one embodiment, the closure thread 20 may have a drafted inner thread face 22 which is angled from the vertical axis A and may be substantially parallel to the closure skirt 16. For example, if the closure skirt 16 is tapered at an angle of about ½° (degree) then the drafted inner thread face 22 is preferably also about ½° (degree).

Figure 7:
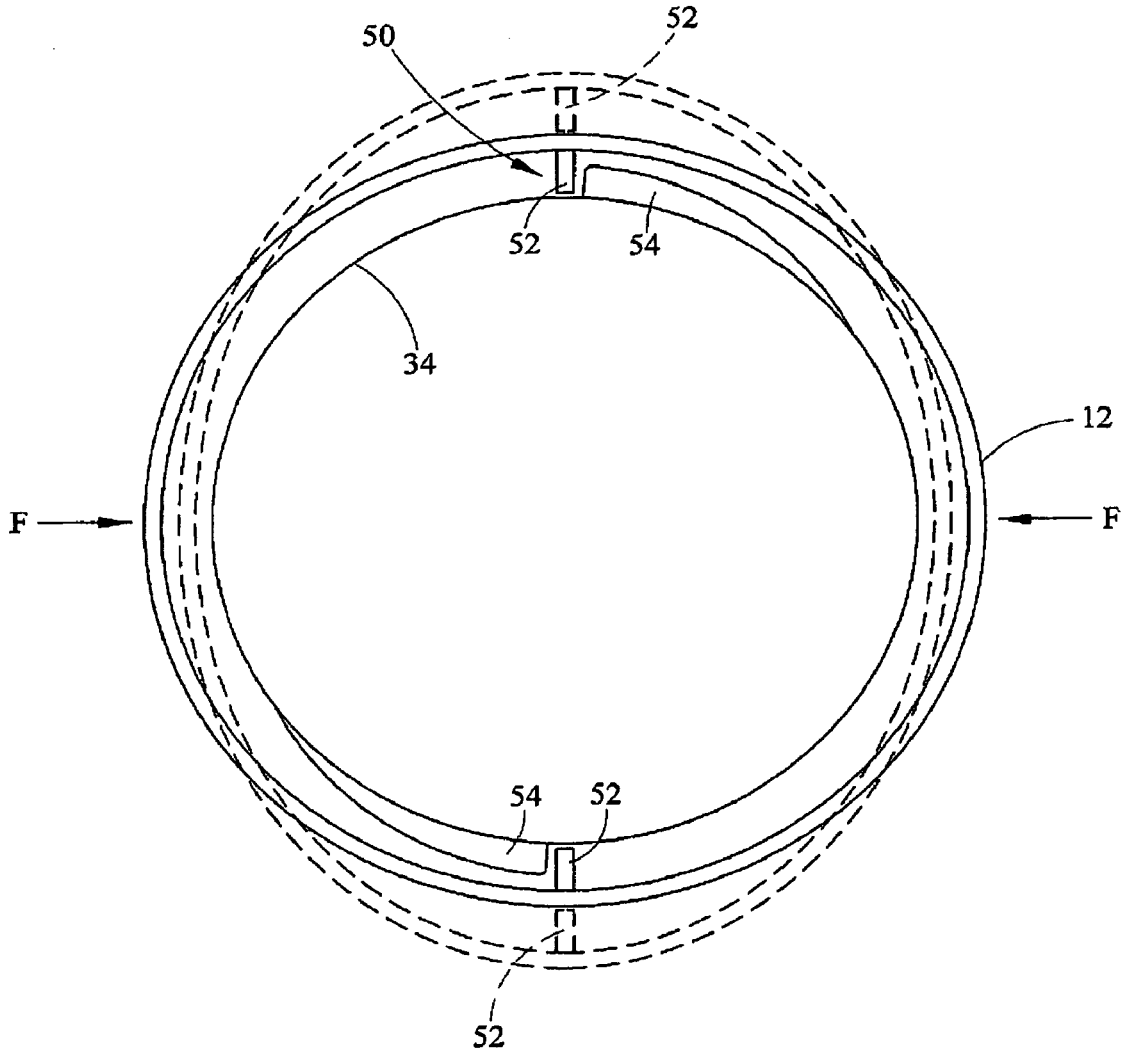
FIG. 7 is a bottom view of a container-closure package of FIG. 2 with child resistant feature.
Figure 8:
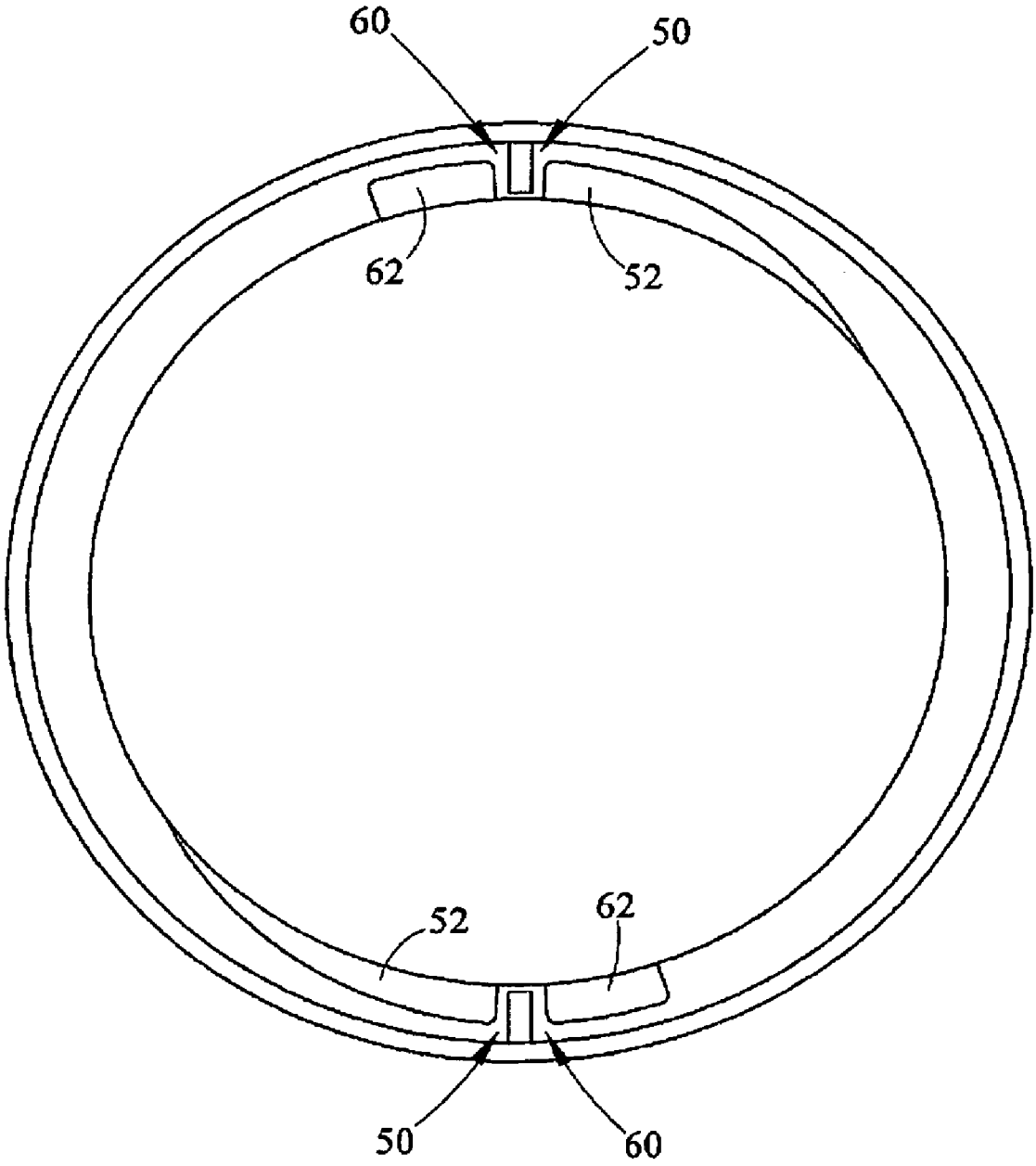
FIG. 8 is a bottom view of the container-closure package of FIG. 7 including an on-stop feature; and, FIG. 9 is a top view of a container neck having a tamper indicating band.
Figure 9:
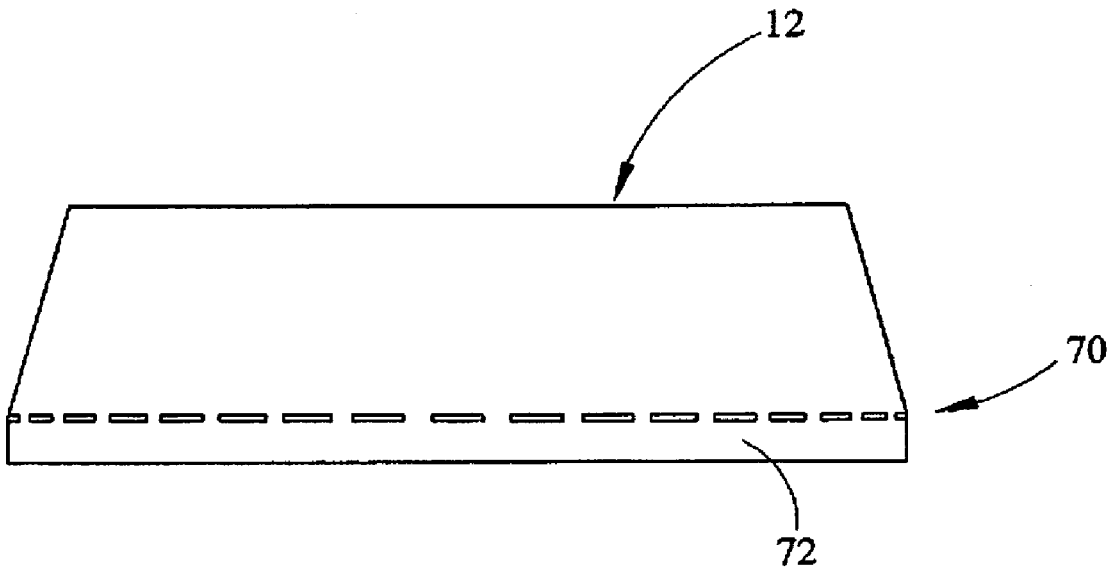

The skirt 16 may also include a child resistant feature or an on-stop feature inhibiting over-torque of the closure 12. For example, as shown in FIG. 7, an exemplary child resistant feature 50 is depicted consisting of a squeeze and turn closure 12. The child resistant feature 50 comprises a closure lug 52 and a container neck lug 54 in engaging relation when the closure is rotated for removal. In order to the overcome the child resistant feature, the closure lug must move radially outward to by-pass the container neck lug 54. In this design the closure 12 must squeezed with opposed forces F about 90° (degrees) from the closure lug 54 in order to ovalize the closure 12 thus moving the closure lugs 54 radially outward. At the same time the closure 12 is turned in an opening direction so that the closure lugs 52 bypass the container lug 54, thus overcoming the child resistant feature 50. Further as shown in FIG. 8, the exemplary child resistant feature 50 is combined with an on-stop device 60 comprising an additional lug 62 inhibiting onward rotation on the closure 12. Inhibiting such rotation limits overtorque damage. As shown in FIG. 9, the closure 12 may also comprise a tamper-indicating feature 70, comprising a tamper-indicating band 72 depending from the lower peripheral edge of the closure 12. Such device may be utilized with a neck bead (not shown) to retain the tamper-indicating band 72 on the container neck indicating to a user that the package has been opened.

Still referring to FIG. 2, a sealing feature 28 may also be utilized with the present invention. A sealing disc 28 is shown extending across the lower surface of the top wall 14 and may be formed of a polymeric material or a laminate of polymeric materials alone or a combination of polymeric and other materials in order to provide a sealing engagement between the closure 12 and the container 30. The sealing feature 28 further provides a resealing feature such that the closure 12 will maintain a seal with the container 30 after initial removal and reapplication of the closure 12 to the container 30. According to an alternative embodiment, the closure 12 may have a sealing surface which engages along an upper outer surface of the container neck 34 forming an external seal in order to inhibit leakage of contents from the container 30 between the closure 12 and the container neck 34. As a further alternative a plug seal or reverse taper plug seal may be used as a sealing feature.

Figure 3:
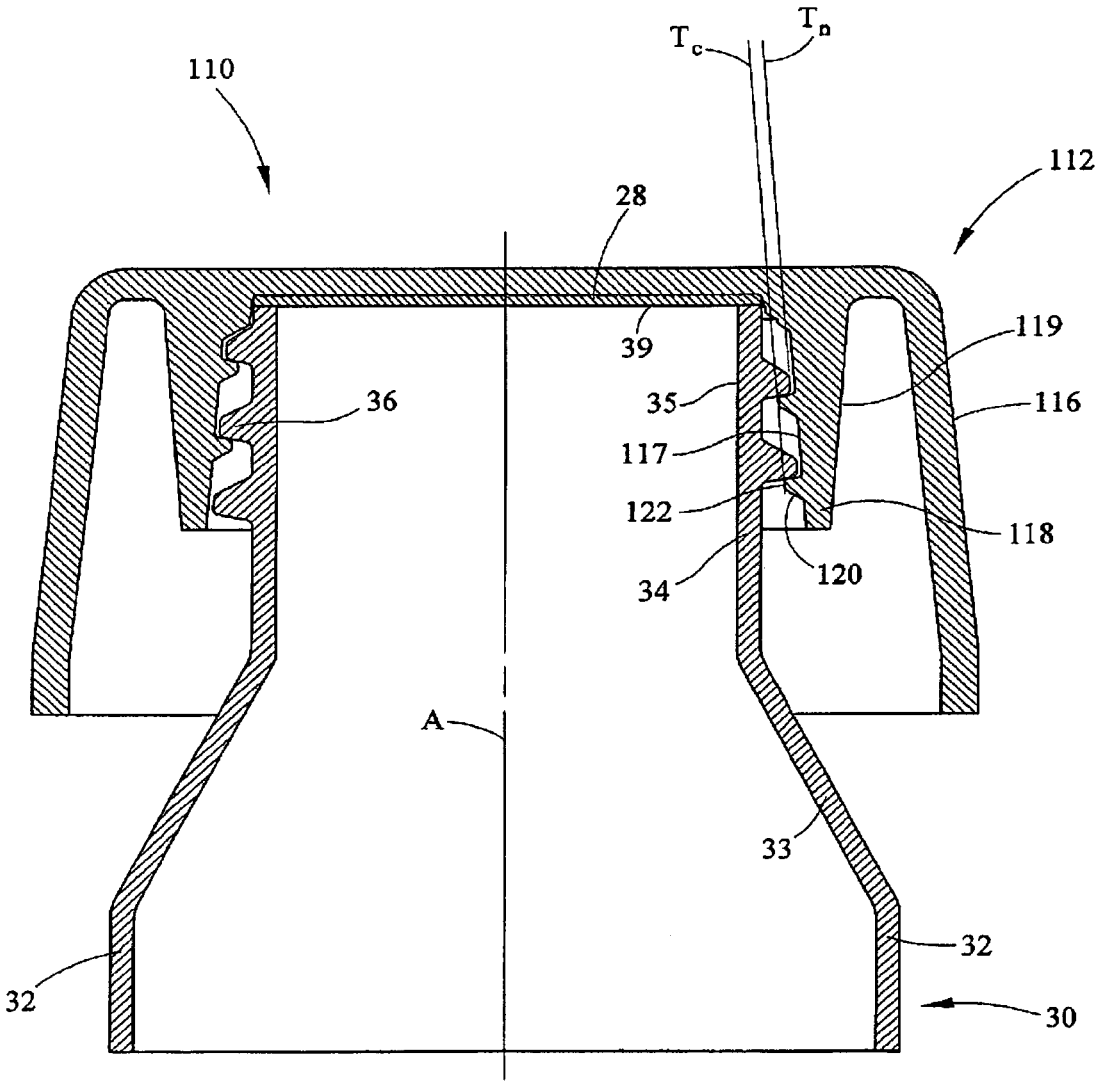
FIG. 3 is a side sectional view of an alternative closure having a double shell closure design.

Referring now to FIG. 3, a side sectional view of an alternative package 110 is shown comprising a double shell closure 112. The double shell closure 112 is depicted having an outer or outermost shell or skirt 116 and an inner or innermost shell 118 which threadably engages a container neck 34. The double shell construction utilizes the outer shell 116 for gripping by a user and further may be tapered, as shown, or depend vertically from the top wall. The inner shell 118 is tapered at an angle to the vertical axis A. The thread 120 is substantially frusto-conical in shape. The inner shell 118 has at least one thread 120 extending inwardly from the inner shell 118. The at least one thread may be multiple helices. The thread 120 utilizes an inner thread face 122 which is tapered at some angle in order to aid with removal of the closure 112 from the mold core. The double shell closure 112 may also be utilized for instance with a sealing disc 28, an external seal engaging the upper outer surface of the container neck 34, a reverse taper or other such plug seal extending inwardly into the container neck and engaging the inner neck wall 35. The double-shell closure 112 may also include the child-resistant feature 50 such as a squeeze and turn design or the on-stop feature 60 for inhibiting overtorquing. Such double shell closure designs are preferable when utilizing a child resistant feature wherein the closure skirt is flexed or ovalized to disengage the child-resistant feature. Single shell closure designs having flexed skirts for disengaging a child resistant feature may adversely affect thread engagement and/or sealing. Alternatively, or in addition to the child resistant feature of FIG. 7, an on-stop feature 60 may be utilized as shown in FIG. 8. An on-stop feature 60 may comprise an additional container lug which engages the closure lug during positioning of the closure 112 on the container neck 34.

As further depicted in FIG. 3, the alternative double-shell closure 112 comprises a substantially frusto-conical shaped inner skirt 118 for ease of removal following molding. Specifically, the inner skirt 118 comprises an inner skirt inner surface 117 and an inner skirt outer surface 119 each tapered and directed inwardly from top to bottom. The surfaces 117 and 199 are tapered substantially equally and oppositely when measured from the closure top wall. Since the inner skirt inner surface 117 is tapered as shown, the gap is maintained between the outer thread surface and the inner skirt inner surface 117, as previously described. The taper of the inner skirt inner surface 117 and outer surface 119 allows for removal of the mold core. According to the exemplary embodiment, the taper of surfaces 117 and 119 may be at angles measured from the closure top wall from between about ¼ degree to about 8 degrees.

Figure 4:
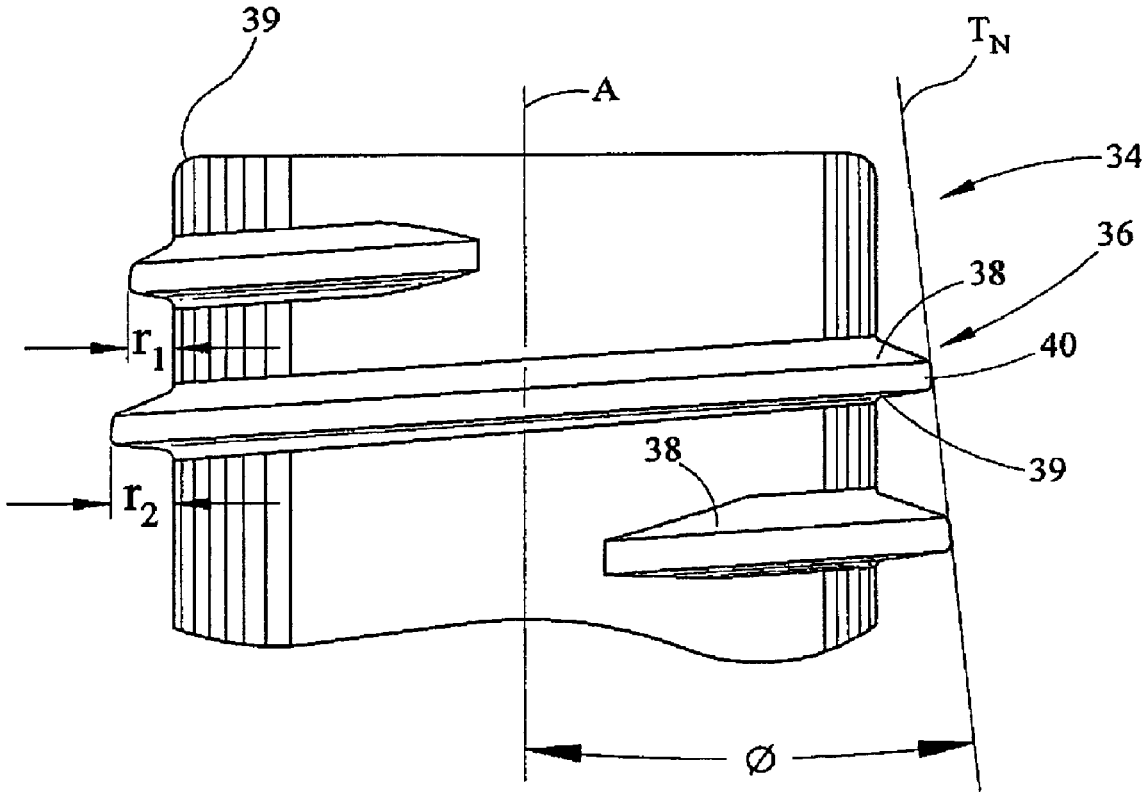
FIG. 4 is a side sectional view of the container neck with drafted threads and removed closure.

With reference now to FIGS. 2-4, the container 30 is shown having a body 32 which is partially shown and a shoulder 33 extending between the body 32 to a substantially vertically extending neck 34. The neck 34 comprises a substantially vertical neck wall 35 having an inner surface and an outer surface and at least one container thread 36. The container neck 34 has a substantially constant radial thickness extending vertically and defining an axial direction. This means that the inner surface and outer surface of the neck 34 are substantially parallel and both extending in a substantially vertical direction rather than one or both surfaces being tapered. The container neck 34 further comprises an upper rim 39 defining an opening or fluid path into and from the container 30. The container rim 39 may engage the sealing disc 28 in order to inhibit leakage between the closure 12 and container 30. Alternatively, or in combination with the sealing disc 28 and container rim 39, the closure 12 may have a sealing surface which engages an upper outer external surface of the neck wall 34 in order to provide a primary or secondary sealing feature for the closure-container package 10.

The at least one container neck thread 36 extends radially outward from the neck wall 35 and helically about the neck wall 35. The neck thread 36 also comprises an asymmetrical frusto-conical shape extending radially from the container neck 34. The neck thread 36 engages the closure thread 20 in order to threadably attach the closure 12 to the container 30 or release the closure 12 therefrom. The thread 36 comprises an upper thread face 38, a lower thread face 39, and a drafted outermost thread face 40 having an angle or taper from the vertical axis A of about θ° (degrees). The angle θ may be between ¼° and 8° (degrees) from the axis A. Preferably, the angle is about 3.5° (degrees) or parallel to the closure skirt 16 or 118. In addition, the angle θ may be parallel to the angle formed by the drafted closure thread face 22 and vertical axis.

As previously described, due to the taper of the skirt 16, prior art container neck finishes have less overlap with or engagement between closure threads which thereby results in stripping of threads and backing off due to creep and the like. The present design overcomes this shortcoming by providing the additional taper on the outer thread face 40 of container neck 34. The additional taper of the outer thread face 40 results in greater overlapping engagement between the closure threads 20 and the container neck thread 36. As shown the thread 36 extends further outwardly in a radial direction from the bottom of the container neck 34 than the top of the neck 34. This is clearly shown in FIG. 4 wherein $r_1$ indicates a first radial length of the thread from container neck 34. Further, $r_2$ indicates a second radial length of the container thread some subsequent rotation or arcuate distance from $r_1$. As shown, $r_1$ is less than $r_2$ indicating the changing radial length of the thread between consecutive or subsequent rotations. Accordingly, as shown in FIG. 2, the line $T_n$ extends along the outer surface of threads 36 indicating the aligned nature of the outer thread faces 40 of container neck 34. Thus, the increased extension in the radial direction results in increased engagement between the closure threads and the container threads. In other words, not only are the angles of the outer thread faces 38 equal and substantially parallel to the closure skirt 16 or 118, but the faces 38 are substantially linearly aligned as indicated by the line $T_n$.

Figure 5:
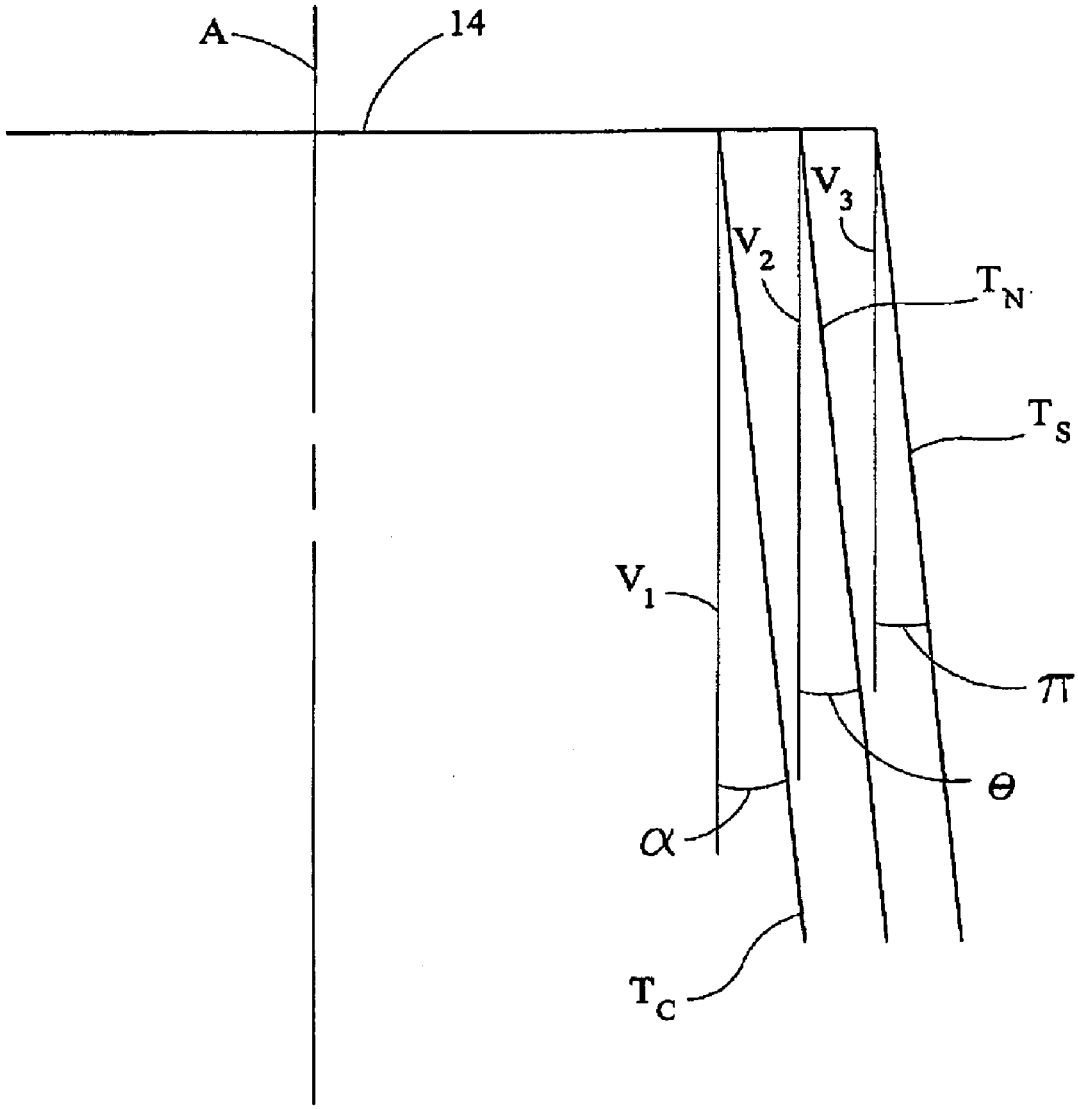
FIG. 5 is a geometric representation of closure thread and bottle thread alignments and further representing the container neck and threads.

Referring now to FIGS. 2, 4 and 5, a geometric representation of the angular relationships of the closure and container package 10 is shown. More specifically, the Figures depict relationships between the inner closure thread face 22, the outer container thread face 40, and the closure skirt 16. A vertical axis A is shown extending through and being substantially perpendicular to the closure top wall 14. A vertical line $V_1$ is depicted adjacent the line $T_c$ representing the inner closure thread face 22 and defining an angle α which may be between about 0° and about 8° (degrees). A second vertical line $V_2$ is depicted adjacent the line $T_n$ representing the outer thread face 40. The second vertical line $V_2$ and line $T_n$ represent an outer thread face 40 define a second angle θ which is between about ¼° and about 8° (degrees) and therefore substantially parallel to line $T_c$. Thus the inner thread face 22 of closure 12 is parallel to the outer thread face 40 of container neck 34. As further shown, a line $T_s$ is depicted representing the closure skirt 16 and has an adjacent vertical line $V_3$ defining an angle π there between. The line $T_s$ representing the closure skirt 16 is shown disposed at an angle π of between about ¼° and about 8° (degrees) and therefore is also parallel to the closure thread face 22 and container thread face 40 although the angle may differ from the closure threads.

Referring again to FIGS. 2 and 4, the line $T_c$ extending along closure thread end points is disposed at the angle α. An adjacent line $T_n$ extends along neck thread end points and is disposed at the angle θ. As depicted in FIG. 2, the lines Tc and $T_n$ are substantially parallel. As one of skill in the art will understand, if the line $T_n$ were vertical, then the engagement between the closure thread 20 and container thread 36 would be decreased moving downwardly along the container neck 34 and closure 12. As a result of the present design, the increased engagement between closure thread 20 and container thread 36 inhibits stripping and loosening or back-off as well as interference between the closure skirt 16,118 and thread 36.

Referring now to FIG. 6, other thread configurations may be utilized with the present invention where appropriate for an application. For instance, multiple helix designs may be used comprising two or more threads extending about the container neck 34. As shown in FIG. 6, the neck 34 may comprise multiple helix threads 136 extending about the neck 34. Although two helices 136 are shown, it should be understood that multiple helices may be used depending on the application and removal characteristics desired and having varying arcuate length.

Although the present invention has been described in terms of specific embodiments which are set forth in detail, it should be understood that this is by illustration only and the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described herein-above.

I claim:

1. A container neck and closure package, comprising:

a container neck extending upwardly from a container and having an upper rim defining a neck opening, said container neck having an upper free end adjacent said upper rim and an opposing distal end;

said container neck having a substantially vertical sidewall of a substantially constant thickness and at least one container neck thread helically extending from said sidewall;

said at least one container neck thread having a drafted outer thread face extending from an inward upper position adjacent said container neck upper free end to an outward lower position adjacent said container neck distal end;

said container neck thread having a first radial length adjacent said container neck upper free end and a second radial length adjacent said container neck distal end, wherein said container neck thread is increasing in radial length from said first radial length adjacent said container neck upper end moving downwardly along consecutive rotations to said second radial length adjacent said container neck distal end;

a closure having a top wall, a substantially vertical axis depending perpendicularly from said top wall, and a skirt depending from said top wall, said skirt having an angled inner surface which is slanted with respect to said vertical axis;

a closure thread extending helically along said angled inner surface of said skirt, said closure thread having a drafted inner thread face which is slanted with respect to said vertical axis; and said drafted outer thread face of said at least one container neck thread and said angled inner surface of said skirt maintaining a substantially constant distance from said angled inner surface of said skirt to said drafted outer thread face of said at least one container neck thread from an upper position of said vertical sidewall to a lower position of sidewall.

2. The container neck and closure combination of claim 1, said drafted outer thread face being substantially parallel to said angled inner surface of said skirt.

3. The container neck and closure combination of claim 1, said drafted outer thread face and said angled inner surface of said skirt defining a gap of constant radial thickness.

4. The container neck and closure combination of claim 1, said drafted outer thread face of said at least one container neck thread being linearly aligned with adjacent rotations of said container neck thread.

5. The container neck and closure combination of claim 1, said closure being a single shell closure.

6. The container neck and closure combination of claim 1, said drafted outer thread face of said at least one container neck thread being disposed at an angle between about one-quarter degree and about eight degrees with respect to said vertical axis.

7. The container neck and closure combination of claim 1, said angled inner surface of said skirt being between disposed at an angle about one-quarter degree and about eight degrees with respect to said vertical axis.

8. The container neck and closure combination of claim 1, wherein said drafted inner thread face of said closure thread is angled by at least about one-quarter degree with respect to said vertical axis.

9. The container neck and closure combination of claim 1, said container neck thread includes an upper surface extending between said drafted outer thread face and said container neck.

10. The container neck and closure combination of claim 9, said container neck thread includes a lower surface extending between said drafted outer thread face and said container neck.

11. A closure and container package, comprising:

a container neck finish having annular walls of a substantially constant thickness and a rim defining a neck opening;

a free end adjacent said rim and an opposing distal end;

at least one thread having a drafted outermost thread face extending from said annular walls;

said at least one thread having an increasing radial length with a first radial length at an upper thread position proximate said container neck finish free end and a second radial length at a lower thread position proximate said container neck finish distal end, whereby said radial length increases from said first radial length to said second radial length;

a closure having a top wall and at least one skirt depending from said top wall, a vertical axis depending perpendicularly from said top wall;

said at least one skirt having an angled inner surface being slanted with respect to said vertical axis from a smaller upper diameter to a larger lower diameter, a closure thread along said angled inner surface of said at least one skirt, said closure thread having a drafted inner thread face which is slanted with respect to said vertical axis; and said angled inner surface of said skirt disposed at an angle with respect to said vertical axis substantially equivalent to a disposition angle of said outermost thread face of said container neck finish thereby forming a substantially consistent clearance between said at least one thread of said container neck finish and said angled inner surface of said skirt between said upper thread position proximate said container neck finish free end and said lower thread position proximate said container neck finish distal end.

12. The package of claim 11 further including a sealing feature.

13. A container neck finish and closure package, comprising:

a substantially vertically extending container neck having a substantially constant wall thickness, said container neck having a rim defining a neck opening, said container neck including a free end adjacent said rim and an opposing distal end;

a neck finish including at least one thread extending helically along said container neck from said free end to said distal end;

said at least one thread having an increasing radial length from said free end to said distal end;

said at least one thread having an asymmetrical frustoconical shape and drafted outermost surface;

said drafted outermost surface of said at least one thread being substantially linearly aligned with subsequent rotations;

a closure having a top wall and a depending skirt, a substantially vertical axis depending perpendicularly from said top wall, said skirt having an angled inner surface which is slanted with respect to said vertical axis;

at least one closure thread disposed along said angled inner surface of said closure skirt, said at least one closure thread having a drafted inner thread face which is slanted with respect to said vertical axis;

a gap disposed between said angled inner surface of said closure skirt and said drafted outermost surface of said at least one thread of said neck finish, said gap having a substantially constant size from said free end to said distal end of said container neck; and a substantially consistent radial distance of overlapping engagement between said at least one thread of said neck finish and said at least one closure thread of said closure skirt from said free end to said distal end of said container neck.

14. The container neck finish of claim 13 said drafted at least one thread of said container neck having an angle of between about one-quarter degree and about 8 degrees with respect to said vertical axis.

* * * * *